US011053573B2

(12) United States Patent
Kishi et al.

(10) Patent No.: US 11,053,573 B2
(45) Date of Patent: Jul. 6, 2021

(54) ELECTROFORMED PART AND TIMEPIECE

(71) Applicant: Seiko Instruments Inc., Chiba (JP)

(72) Inventors: Matsuo Kishi, Chiba (JP); Miei Takahama, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 24 days.

(21) Appl. No.: 16/511,959

(22) Filed: Jul. 15, 2019

(65) Prior Publication Data

US 2020/0024710 A1 Jan. 23, 2020

(30) Foreign Application Priority Data

Jul. 17, 2018 (JP) ..... JP2018-133920

(51) Int. Cl.
*C25D 1/00* (2006.01)
*C22C 38/08* (2006.01)
*G04B 1/14* (2006.01)

(52) U.S. Cl.
CPC ..... *C22C 38/08* (2013.01); *C25D 1/00* (2013.01); *G04B 1/145* (2013.01); *C22C 2200/00* (2013.01)

(58) Field of Classification Search
None
See application file for complete search history.

(56) References Cited

U.S. PATENT DOCUMENTS 9,005,420 B2 * 4/2015 Tomantschger ..... C25D 5/14 205/102
9,310,772 B2 4/2016 Konishi et al.

FOREIGN PATENT DOCUMENTS

JP H1115126 A 1/1999

* cited by examiner

*Primary Examiner* — Daniel J. Schleis
(74) *Attorney, Agent, or Firm* — Brinks Gilson & Lione

(57) ABSTRACT

An object of the present invention is to provide an electroformed part favorable for an assembly part of a timepiece or the like and a timepiece using the same. The present invention relates to an electroformed part, which is an electroformed part composed of a nickel-iron alloy constituted by nickel, iron, and unavoidable impurities, containing iron at 5 to 25% by mass, and having a roughly layered form portion in which a stacked form portion having an inclined iron content in a thickness direction is repeatedly stacked a plurality of times. It is preferred that the stacked portion is constituted by crystal grains having an average grain diameter of 50 nm or less.

10 Claims, 9 Drawing Sheets

ELECTROFORMED PART AND TIMEPIECE

RELATED APPLICATIONS

Priority is claimed on Japanese Patent Application No. 2018-133920, filed on Jul. 17, 2018, the content of which is incorporated herein by reference.

BACKGROUND OF THE INVENTION

1. Field of the Invention

The present invention relates to an electroformed part by an electroplating method and a timepiece using the same.

2. Description of the Related Art

Conventionally, a watch that is one of the small precision machines, particularly a mechanical watch is equipped with a large number of small machine parts such as gears and springs.

A small machine part of this type has been conventionally produced mainly by machining such as cutting or punching, however, recently, a production method by an electroforming method is being adopted. This is because it has an advantage that a machine part formed by the electroforming method has smaller dimensional tolerance than a part formed by machining, and also even a complicated shape can be precisely formed. In particular, according to a technique called UVLIGA (Lithographie Galvanofomung Abformung) in which photolithography and an electroplating method are combined, an electroformed part with very high precision can be produced (see, for example, JP-A-11-15126 (Patent Document 1)).

On the other hand, as a material widely used in an electroformed part, there is a nickel electroformed body, however, this material has poor creep property and stress relaxation property, and therefore, the use thereof as a spring part has been regarded to be difficult.

In such circumstances, application of an alloy composed of nickel and iron having excellent creep resistance property and stress relaxation resistance property to an electroformed part has been attempted, and a technique for improving the properties by optimizing the composition, the crystal grain size, the hardness, etc., and further by performing a heat treatment or the like has emerged (see, for example, JP-A-2014-198897 (Patent Document 2)).

However, in order to improve the creep resistance property and the stress relaxation resistance property by the electroformed nickel-iron alloy part, it is necessary to increase the content of iron, however, when the content of iron exceeds about 25%, it is in an unstable state as an electroformed body and has a problem that it is difficult to obtain a dense and tough electroformed body.

This is because in addition to deterioration of the stability of an electroforming solution when forming an electroformed body, iron is stably incorporated into a face-centered cubic structure that is a nickel crystal as a substituted structure up to an iron content of about 25%, however, when the iron content is increased to 25% or more, distortion is increased and moreover, a body-centered cubic lattice phase that is an iron structure is formed, and therefore, there arises a problem that it becomes a very unstable structure as an electroformed body, and brittleness and a decrease in strength as a structure are caused.

SUMMARY OF THE INVENTION

It is an aspect of the present application to provide an electroformed part having high precision and also having excellent hardness and Young's modulus and also having an excellent stress relaxation resistance property, and also to provide a timepiece using the electroformed part as an assembly part.

[1] An electroformed part according to one aspect of the present application is an electroformed part composed of a nickel-iron alloy that is constituted by Ni, Fe, and unavoidable impurities, contains Fe at 5 to 25% by mass, and has a roughly layered form portion in which a stacked portion having an inclined Fe content in a thickness direction is repeatedly stacked a plurality of times.

[2] In the electroformed part according the above aspect, it is preferred that the stacked portion is constituted by crystal grains having an average grain diameter of 50 nm or less as measured by X-ray diffractometry.

[3] In the electroformed part according the above aspect, it is preferred that a crystal form of the crystal grain constituting the stacked portion is a face-centered cubic lattice single layer, and a nickel atom is partially substituted by an iron atom.

[4] In the electroformed part according the above aspect, it is preferred that an iron content gradient in the stacked portion is formed by stacking the crystal grains having different iron contents.

[5] In the electroformed part according the above aspect, it is preferred that an iron content in the individual crystal grains constituting the stacked portion has an inclined gradient, and the sizes of the crystal grains in the stacked portion are changed toward substantially one direction.

[6] In the electroformed part according the above aspect, it is preferred that in an inclined iron composition in the stacked portion, with respect to an intermediate concentration which is an intermediate value between the maximum Fe concentration and the lowest Fe concentration, the iron composition is inclined within a concentration difference range of ±15% or more and ±50% or less of the intermediate concentration.

[7] In the electroformed part according the above aspect, it is preferred that the stacked portion has a layer thickness of 500 nm or more and 10 μm or less.

[8] In the electroformed part according the above aspect, it is preferred that a direction substantially parallel to layers constituting the stacked portion is set to a mechanical load direction.

[9] A timepiece according to one aspect of the present application in which an assembly part composed of the electroformed part according to any one of the previous items is provided.

[10] In the timepiece according this aspect, it is preferred that the assembly part is a spring part.

According to the electroformed part of this aspect, a part is composed of a nickel-iron alloy containing Fe at 5 to 25% as an average value and has a roughly layered form portion in which a stacked portion having an inclined Fe content in a thickness direction is repeatedly stacked a plurality of times, and therefore, has excellent creep resistance property and stress resistance property, and has high precision, and also has an excellent spring property can be obtained.

Therefore, the electroformed part with high precision can be applied to a spring part, and the precision of a device (for example, a timepiece or the like) using the part with high precision is also improved. Further, since it is an electroformed part, the degree of freedom in the shape of the part is increased, and therefore, it also contributes to reduction in size of a mechanism or a part which was difficult with a material formed by conventional machining.

BRIEF DESCRIPTION OF THE DRAWINGS

FIG. 1A is a side view showing the overall shape of the electroformed body, and FIG. 1B is a partially enlarged cross-sectional view taken along the line A-A1 of the electroformed body.

FIG. 2A is an enlarged view showing an outline of a stacked portion having an inclined composition, and FIG. 2B is an enlarged view showing an outline of a stacked portion having an inclined Fe composition constituted by crystal grains having different compositions.

FIG. 3A is a cross-sectional view showing a state where an electrode layer is formed on a substrate, FIG. 3B is a cross-sectional view showing a state where a photoresist is formed on the electrode layer, FIG. 3C is a cross-sectional view showing a state where an electroforming mold is formed by opening a portion of the photoresist, FIG. 3D is a cross-sectional view showing a state where an electroformed body is formed in the electroforming mold, FIG. 3E is a cross-sectional view showing a state where the surface of the electroformed body is flattened, and FIG. 3F is a cross-sectional view showing an electroformed body taken out from the electroforming mold.

FIG. 4A is a cross-sectional view showing the electroforming mold, and FIG. 4B is a cross-sectional view showing a state of iron ions and nickel ions immediately before deposition in a state of performing electroforming.

FIG. 5A is a cross-sectional view showing a state where a stacked portion having an inclined iron composition is formed in the electroforming mold, and FIG. 5B is a cross-sectional view showing a state after an electroforming bath is stirred or shaken in the middle of performing electroforming.

FIG. 7A is a graph showing one example of results of measuring an Fe composition in a depth direction from a surface of the electroformed body by an SEM, and FIG. 7B is an SEM image showing a measurement direction in a transverse section of the electroformed body.

FIG. 8A is a graph showing one example of results of measuring an Fe composition in a depth direction from a surface of the electroformed body by an SEM, and FIG. 8B is an SEM image showing a measurement direction in a transverse section of the electroformed body.

FIG. 9A is a graph showing one example of results of measuring an Fe composition in a depth direction from a surface of the electroformed body by an SEM, and FIG. 9B is an SEM image showing a measurement direction in a transverse section of the electroformed body.

DETAILED DESCRIPTION OF THE PREFERRED EMBODIMENTS

Figure 1A:
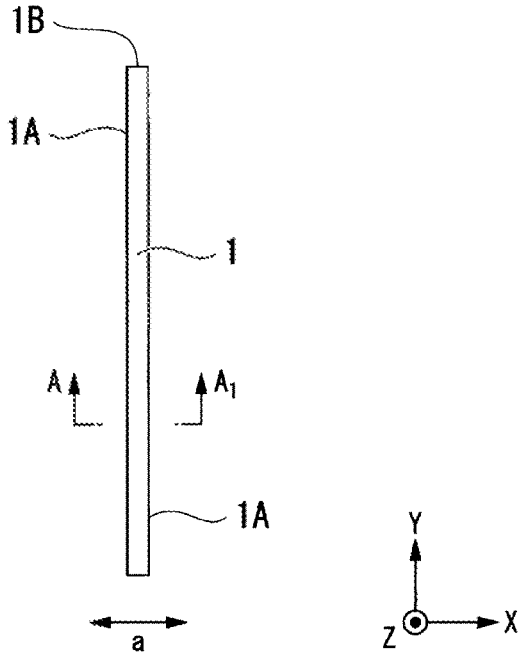
FIGS. 1A and 1B show an electroformed body of a first embodiment according to the present invention.

Hereinafter, by showing an example of an electroformed body (electroformed part) that is a first embodiment of the present invention, a configuration thereof will be described in detail with reference to FIG. 1A to FIG. 2B. Incidentally, in the drawings used in the following description, in order to make respective portions have a recognizable size, the respective portions are shown by appropriately changing the reduced scales thereof. Therefore, the relative sizes of the respective portions are not limited to those shown in the drawings.

[Electroformed Part]

An electroformed body (electroformed part) 1 of this embodiment is, for example, a plate-like body as shown in FIG. 1A, and preferably has a composition containing Fe at 5 to 25% by mass with the remainder being Ni and unavoidable impurities. Incidentally, as the unavoidable impurities, S that is unavoidably introduced from the below-mentioned electroforming bath may be contained within a range of about 0.005 to 0.2%.

Figure 1B:
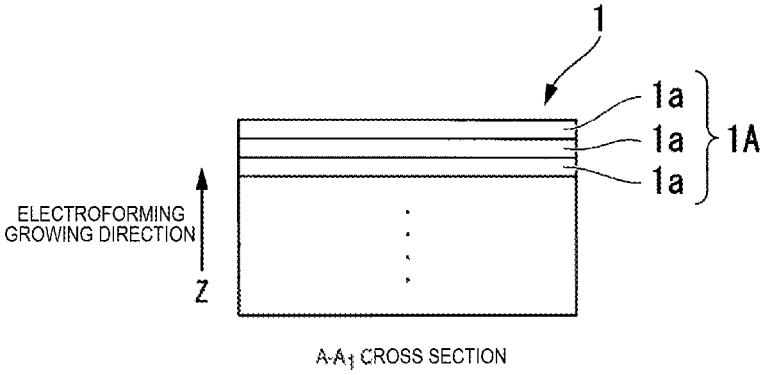
Figure 2A:
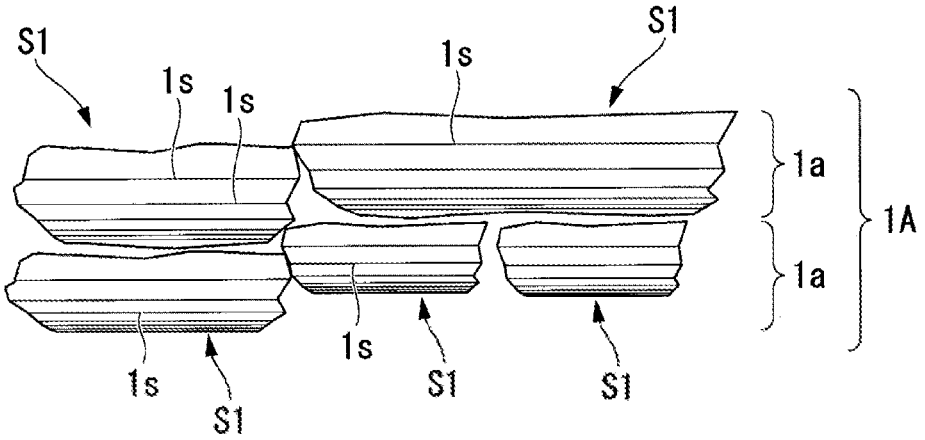
FIGS. 2A and 2B show a portion of a structure of the electroformed body in an enlarged scale.

The electroformed body 1 of this embodiment is composed of a roughly layered form portion 1A in which a stacked portion 1*a* having an inclined iron content in a thickness direction thereof (a vertical direction in FIG. 1B and FIGS. 2A and 2B) is repeatedly stacked a plurality of times as shown in an A-$A_1$ cross section shown in FIG. 1B and a cross section in FIG. 2A. The electroformed body 1 in a plan view state shown in FIG. 1A is in a vertically slender rectangular shape composed of a long side 1A in a length direction thereof and a short side 1B in a width direction thereof, and when a direction parallel to the short side 1B is defined as X direction and a direction parallel to the long side 1A is defined as Y direction, Z direction is defined as the thickness direction of the electroformed body 1.

The electroformed body 1 of this embodiment is a machine part to be utilized as, for example, a plate spring, and is preferably used such that a direction in which a load is made to act is the arrow a direction, that is, a bending or mechanical force acts in the ±X direction.

Figure 2B:
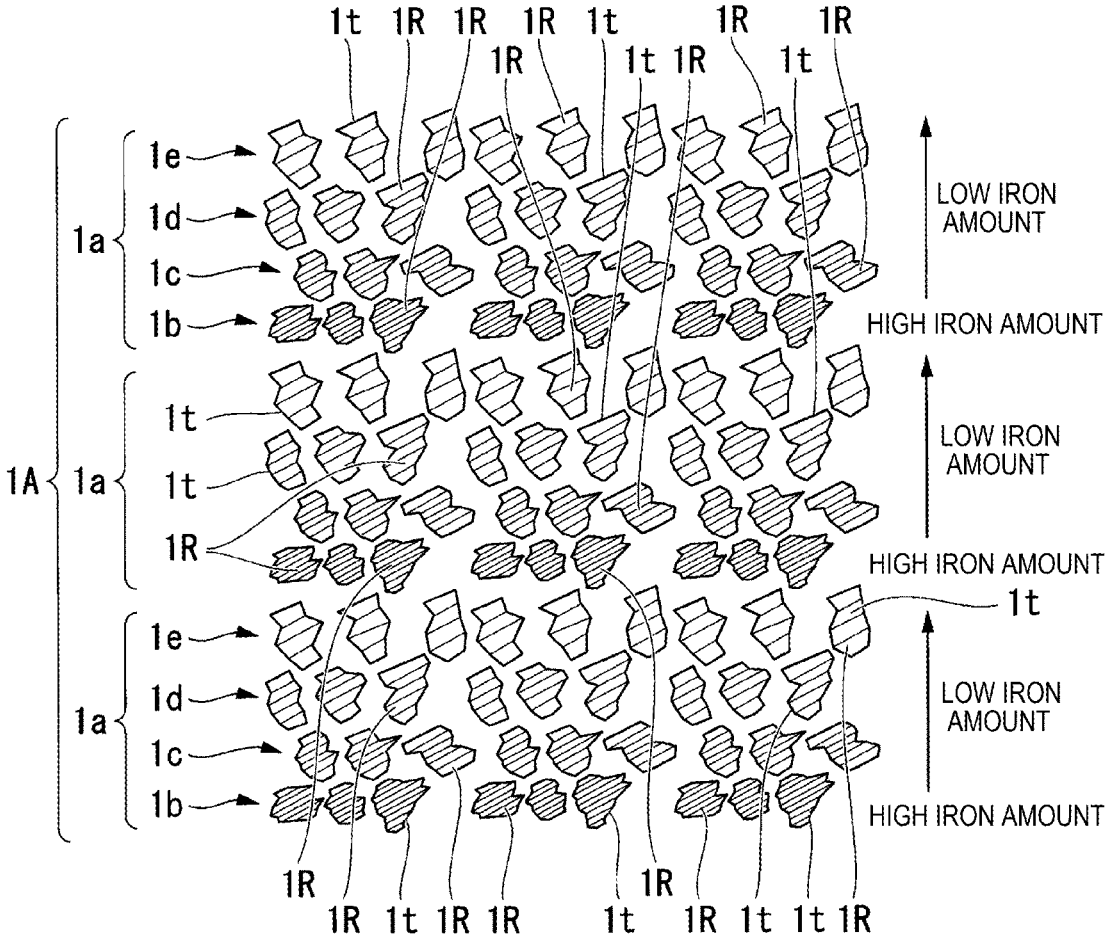

In FIG. 2A, an outline of the stacked portion 1*a* constituting a structure of the electroformed body 1 is shown, and in FIG. 2B, a detailed enlarged partial cross-sectional structure of the stacked portion 1*a* is shown.

The stacked portion 1*a* constituting the electroformed body 1 is formed by the below-mentioned electroforming method, and therefore, unlike a stacked body of a uniform stacked film of a single layer film or the like to be stacked by a deposition method such as a sputtering method, a film is grown by depositing crystal grains at deposition positions or various positions in the thickness direction, whereby the electroformed body 1 is formed. Therefore, as shown in FIG. 2A, it is not that the stacked portion 1*a* is uniformly grown in the film thickness direction (vertical direction) and the planar direction (horizontal direction) in FIG. 2A, but that the stacked portion 1*a* is deposited while growing so as to include some positional displacement in these directions. An outline of such a state is shown in FIG. 2A, however, when a plurality of border lines 1*s* each schematically showing a border of an Fe content gradient are drawn, the stacked portion 1*a* is formed such that three regions S1 that can be divided so as to gather the border lines 1*s* are arranged side by side in a first layer in FIG. 2A, and the stacked portion 1*a* as a second layer is formed by further stacking two different regions S1 arranged side by side thereon.

In FIG. 2A, blank portions drawn like voids between the regions S1 do not mean that crystal grains are not present in these portions, but mean that crystal grains are present also in these portions, but the crystal grains deposited while having an Fe content that does not meet the adjacent border line is are present, and therefore these portions are not shown as the regions S1. Therefore, FIG. 2A shows only a state where crystal grains present in each region S1 are deposited as the stacked portion 1*a* so that the border lines 1*s* can be drawn, and is drawn as a schematic view showing a state where the roughly layered form portion 1A is constituted by depositing a plurality of these.

In this embodiment, the thickness of the stacked portion 1*a* is about 500 nm to 10 μm.

Incidentally, when the upper limit and the lower limit of the numerical range in this specification are described using "to", the range shall include the upper limit and the lower limit unless otherwise specified. Therefore, the "500 nm to 10 μm" means a range of 500 nm or more and 10 μm or less.

FIG. 2B is a schematic partial cross-sectional view showing the structure of the electroformed body 1 in a further enlarged scale. The level of Fe content in each region surrounded by a division line 1*t* in an irregular granular shape is expressed by the degree of density of diagonal lines. Among the respective regions, a region with the highest density of diagonal lines is a crystal grain 1R having the highest Fe content, a region with the second highest density of diagonal lines is a crystal grain 1R having the second highest Fe content, a region with the third highest density of diagonal lines is a crystal grain 1R having the third highest Fe content, and a region with the fourth highest density of diagonal lines corresponds to a crystal grain 1R having the fourth highest Fe content.

In FIG. 2B, for convenience, a layer composed of the crystal grains 1R having the highest Fe concentration is defined as a first crystal layer 1*b*, a layer composed of the crystal grains 1R having the second highest Fe concentration is defined as a second crystal layer 1*c*, a layer composed of the crystal grains 1R having the third highest Fe concentration is defined as a third crystal layer 1*d*, and a layer composed of the crystal grains 1R having the fourth highest Fe concentration is defined as a fourth crystal layer 1*e*, and a state where the stacked portion 1*a* is formed from an assembly of the four types of crystal layers is shown.

Also in FIG. 2B, in the same manner as in the case of FIG. 2A, it is not that crystal grains are not present in blank regions outside the respective regions surrounded by the division lines 1*t*, but that crystal grains are also present in these blank regions, and the division lines it and the diagonal lines are merely not shown. Therefore, it can also be said that FIG. 2A is a schematic view showing a state of the Fe concentration only in the respective regions surrounded by the division lines 1*t*.

Incidentally, in FIG. 2B, in order to simplify the description, only four layers of the crystal layers from 1*b* to 1*e* are drawn, however, in the actual electroformed body 1, the stacked portion 1*a* is constituted by a lot more crystal layers. The number of crystal layers in the stacked portion 1*a* will be described later.

In this embodiment, one region surrounded by the division line 1*t* and having an equal Fe concentration is regarded to correspond to one crystal grain 1R. As for the size of this crystal grain 1R, for example, the average grain diameter is presumed to be 50 nm or less, more specifically, from 20 to 30 nm. Incidentally, with respect to the specific size of the crystal grain 1R, it has been confirmed that the average grain diameter is 50 nm or less, more specifically, from 20 to 30 nm by subjecting samples of the below-mentioned Examples to an X-ray analysis.

As described above, the electroformed body 1 of this embodiment has the roughly layered form portion 1A in which the stacked portion 1*a* having an inclined Fe content in the thickness direction is repeatedly stacked a plurality of times. Then, each stacked portion 1*a* is composed of a stacked structure of the first crystal layer 1*b* composed of the crystal grains 1R having a substantially equal Fe concentration, the second crystal layer 1*c* composed of the crystal grains 1R having a substantially equal Fe concentration, the third crystal layer 1*d* composed of the crystal grains 1R having a substantially equal Fe concentration, and the fourth crystal layer 1*e* composed of the crystal grains 1R having a substantially equal Fe concentration. Incidentally, the number of crystal layers constituting each stacked portion 1*a* is specifically not 4, but an arbitrary number.

As one example, the thickness of the stacked portion 1*a* is from about 500 nm to 10 μm, and therefore, when assuming that the average crystal grain diameter is from 20 to 30 nm, the stacked portion 1*a* is formed from several tens to several hundreds of crystal layers.

In the electroformed body 1 of this embodiment, it is desired that the crystal forms of the individual crystal grains 1R are each a face-centered cubic lattice single layer, and a crystal form in which a Ni atom is partially substituted by an Fe atom. In the Ni—Fe alloy, if the Fe content is within a range of 5 to 25% by mass, the crystal grain can have a crystal form in which a Ni atom is partially substituted by an Fe atom, and in such a case, the electroformed body 1 capable of obtaining excellent mechanical properties as described below is obtained.

It is preferred that the Fe content in the individual crystal grains constituting the stacked portion 1*a* has an inclined gradient, and also the sizes of the crystal grains 1R in the stacked portion 1*a* change toward substantially one direction.

For example, the grain diameter of the crystal grain 1R increases as the Fe content decreases. Further, when the stacked portion 1*a* is formed, the grain diameter of the crystal grain 1R increases in a transverse direction (a vertical direction with respect to a growing direction of the stacked portion 1*a*) as stacking proceeds (the thickness direction).

Incidentally, when the Fe content increases in the electroformed body 1, the grain diameter of the crystal grain 1R tends to decrease. Therefore, when the Fe content is low, the grain diameter of the crystal grain 1R tends to increase. Therefore, a layer (crystal grains) having a high Fe content is newly grown in a portion where the grain diameter of the crystal grain 1R is large, and the crystal grain is grown to become large. Therefore, the crystal grain 1R tends to become large in the growing direction. Further, in the thickness direction, the composition is controlled, and therefore, the size of the crystal grain 1R hardly increases in the thickness direction along with stacking, and tends to increase in the transverse direction.

[Method for Producing Electroformed Body]

Next, a method for producing an electroformed body configured as described above will be described.

When the electroformed body 1 is produced, it is important to deposit the electroformed body having the above-mentioned composition, and therefore, it is preferred to adjust and compound the composition of an electroforming solution and perform electroforming so as to achieve the composition.

As a Ni source, nickel sulfate, nickel chloride, nickel sulfamate, or the like can be used, and as a Fe source, ferrous sulfate, ferrous chloride, ferrous sulfamate, or the like can be used. Further, as a buffer, boric acid, acetic acid, citric acid, or the like may be added to the electroforming solution.

Further, as a pit inhibitor, a surfactant such as a sulfate surfactant or an alkyl sulfonate surfactant may be added to the electroforming solution. Further, as a primary brightener, sodium saccharin, sodium naphthalene sulfonate, or p-toluene sulfonamide, and as a secondary brightener, butynediol, formaldehyde, or the like may be added to the electroforming solution. Further, an antioxidant such as ascorbic acid or isoascorbic acid or a complexing agent such as malonic acid, tartaric acid, or succinic acid may be added to the electroforming solution.

Herein below, preferred examples of an electroforming bath composition and electroforming conditions in this embodiment will be shown, however, the electroforming bath composition and the electroforming conditions may be appropriately changed within a range not impairing the advantageous effects of the present invention, that is, as long as the bath composition and the conditions cause deposition of an electroformed body containing Fe at 5 to 25% with the remainder being Ni and unavoidable impurities, and the present invention is not limited to the examples shown below.

However, when the electroformed body 1 is produced as described below, it is necessary to stir the electroforming solution at every predetermined time or to shake, vibrate, or rotate the electroforming mold immersed in the electroforming solution at every predetermined time while depositing grains by electroforming to produce the electroformed body 1.

When the electroforming mold is rotated, an electroforming step can be performed by repeating rotation at 10 rpm for a rotation time of 5 to 20 seconds and resting for a rest time of about 100 to 115 seconds.

Electroforming Bath Composition nickel sulfamate tetrahydrate: 200 to 300 g/L
nickel chloride hexahydrate: 2 to 10 g/L
ferrous sulfamate pentahydrate: 5 to 50 g/L
boric acid: 10 to 50 g/L
surfactant: 0.1 to 10 g/L
primary brightener: 1 to 15 g/L
secondary brightener: 0.05 to 5 g/L
antioxidant: 0.1 to 10 g/L
pH: 2 to 4
bath temperature: 40 to 60° C.

Electroforming Conditions cathode current density: 1 to 10 A/dmin$^2$

By performing the electroforming step using an electroforming facility having an electroforming bath constituted as described above, the electroformed body 1 can be produced.

Incidentally, in this embodiment, "S: 0.005 to 0.2%" is defined, however, an S source of this embodiment is included in nickel sulfamate tetrahydrate, ferrous sulfamate pentahydrate, the surfactant, and the primary brightener in the above-mentioned electroforming bath composition. In the electroforming step, metal ions react in a cathode, thereby depositing a metal, however, at that time, nonmetal ions, the brighteners, etc. adhered to the surface of the cathode are incorporated together. Therefore, elements contained in the bath composition such as S, O, and H that are generally regarded as unavoidable impurities cause eutectoid. That is, in this embodiment, by adjusting the composition of nickel sulfamate tetrahydrate or the like described above, the amount of S can be controlled.

Further, S is an impurity, and it is preferred that the content thereof is as low as possible from the viewpoint of the properties of the alloy, however, excessive reduction may increase the electroforming cost, and therefore, in this embodiment, the content is preferably set within a range of 0.005% to 0.2%.

The electroformed body according to this embodiment has the above-mentioned composition, but may contain other trace elements within a range not impairing the advantageous effects of the present invention.

Next, an electrode for electroforming to be used for electroforming will be described.

FIGS. 3A to 3F are views illustrating a step of forming an electrode for electroforming.

Figure 3A:
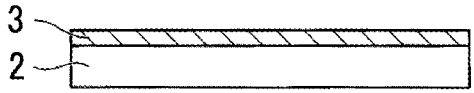
FIGS. 3A to 3F show one example of a method for producing the electroformed body.

First, as shown in FIG. 3A, an electrode 3 to become a cathode in an electroforming step is formed on a substrate 2.

For the substrate, various materials such as stainless steel and Ti other than silicon, quartz, and sapphire can be used. As a material of the electrode 3, Cu, Au, Cr, Ti, or the like can be used. Incidentally, when a metal material is adopted as the substrate 2, the electrode 3 may not be formed. In such a case, the substrate 2 can be made to function as the electrode (cathode) for electroforming.

The thickness of the substrate 2 is preferably set to 100 μm to 1 mm so that it can stand by itself in the subsequent step. Further, the thickness of the electrode 3 is preferably set to 10 nm or more from the viewpoint of ensuring stable conduction in the below-mentioned electroforming step and the minimum strength. On the other hand, when the thickness of the electrode 3 is too thick, the electrode may be peeled due to an action of stress or a problem that deposition takes time occurs, and therefore, the thickness of the electrode 3 is preferably set to 10 μm or less.

Figure 3B:
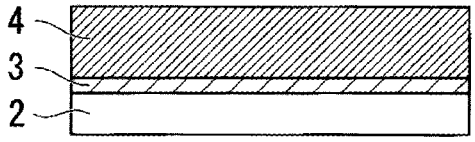

FIG. 3B is a view illustrating a resist forming step.

As shown in FIG. 3B, a photoresist 4 is deposited on the electrode 3. The photoresist 4 may be a negative type or a positive type and can be deposited using a spin coating method or a dip coating method. Incidentally, when a dry film resist is used as the photoresist, the photoresist 4 can be deposited using a laminating method.

The thickness of the photoresist 4 is equal to or more than the thickness of an electroformed body 1 to be formed in a subsequent step.

In the following description, a case where a negative type is the used as the photoresist 4 will be described.

Figure 3C:
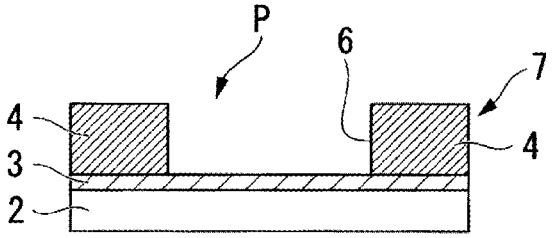

FIG. 3C is a view illustrating a developing step.

As shown in FIG. 3C, first, the photoresist 4 is irradiated with an ultraviolet ray using a photomask (not shown) having a contour pattern of the electroformed body 1 (see FIG. 3F) to be formed in the subsequent step, thereby curing the photoresist 4 other than a portion in which an electroformed material is to be deposited in an electroforming step as the subsequent step. Subsequently, the photoresist 4 (in the portion in which the electroformed body is to be deposited) which is not cured is removed, thereby forming an electroforming mold 7 having a pattern portion P for forming a contour shape of the electroformed body 1 (see FIG. 3F). The pattern portion P shown in the drawing includes a recessed portion 6 for forming the contour shape of the electroformed body 1. In addition, although not shown in the drawing, it is assumed that a plurality of pattern portions P described above are formed along a matrix direction in the electroforming mold 7.

Incidentally, the method for forming the electroforming mold 7 in this embodiment has been described by showing the step of forming the electrode for electroforming to the developing step as shown in FIG. 3A to 3C as an example, however, the present invention is not limited thereto, and another known method may be adopted as the method for forming the electroforming mold 7.

Figure 3D:
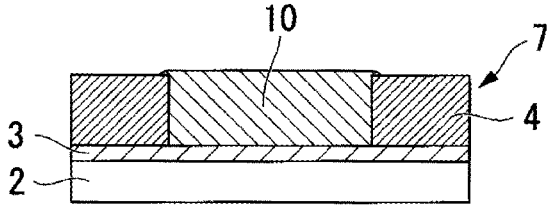

The electroforming mold 7 is set in an electroforming device (not shown), and the electroformed body 1 composed of a Ni—Fe alloy is formed on the exposed electrode 3 as shown in FIG. 3D.

The electroforming device has an electroforming tank, in which the above-mentioned electroforming solution containing Ni ions and Fe ions is stored, and includes an anode immersed in the electroforming solution and a power supply portion connected to each of the anode and the electrode (cathode) 3 of the electroforming mold 7 through an electric wiring.

After the electroforming mold 7 is immersed in the electroforming solution in a state of being attached to a jig (not shown), the power supply portion is activated and a voltage is applied between the anode and the cathode. Then, Ni ions and Fe ions in the electroforming solution move in the solution to the cathode side and are deposited as a Ni—Fe alloy on the surface of the cathode 3, and further, the alloy is grown to form a metal stacked body 10.

Figure 4A:
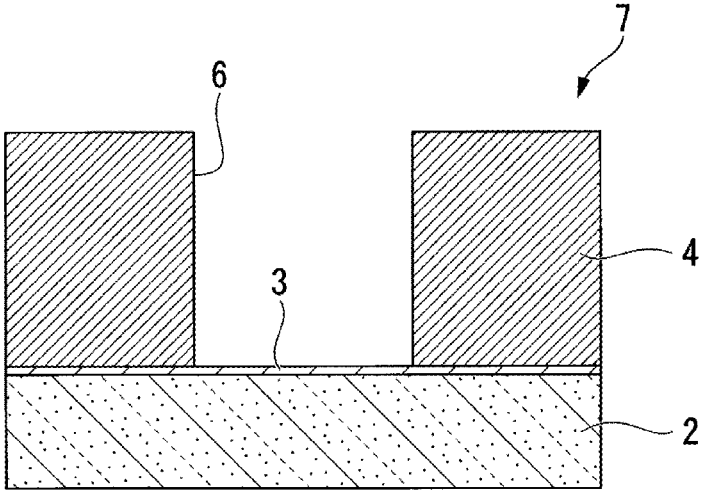
FIGS. 4A and 4B show views for illustrating details of a state of performing electroforming using the electroforming mold.
Figure 4B:
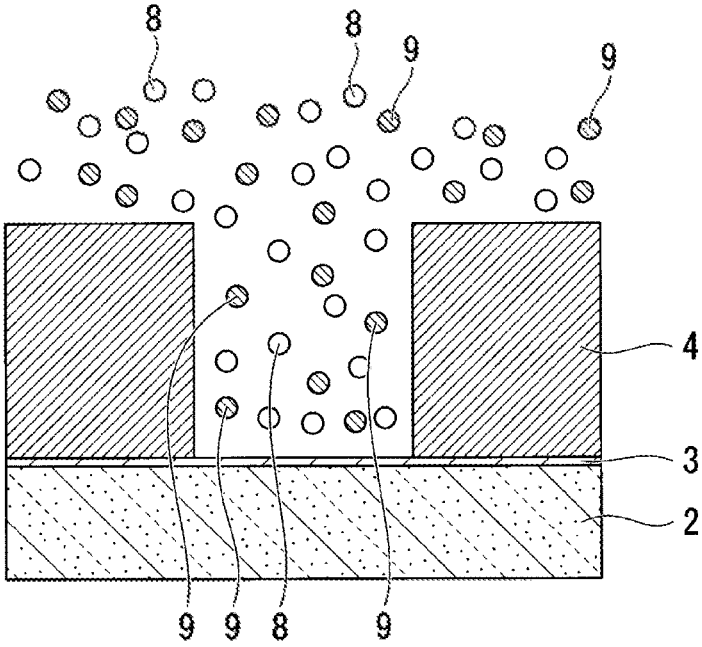

In FIG. 4A, an enlarged structure of the electroforming mold 7 is shown, and in FIG. 4B, a state where the electroforming mold 7 is immersed in the electroforming solution and Ni ions and Fe ions in the electroforming solution are present around the recessed portion 6 is schematically shown. In FIG. 4B, white circles indicate Ni ions 8, and hatched circles indicate Fe ions 9. In the state shown in FIG. 4B, the Ni ions 8 and the Fe ions 9 are substantially evenly dispersed inside the recessed portion 6.

When the power supply portion is activated and a voltage is applied between the anode and the electrode (cathode) 3 as described above in this state, the Ni ions 8 and the Fe ions 9 are deposited on the surface of the electrode 3, and a stacked portion 1*a* composed of an Ni—Fe alloy is deposited, however, the Fe ions 9 are preferentially deposited over the Ni ions 8, and therefore, crystal grains 1R having a high Fe concentration are deposited in the stacked portion 1*a*. When deposition is allowed to proceed, Fe ions present inside the recessed portion 6 gradually decrease, and therefore, crystal grains 1R having an Fe concentration gradually decreased as the deposition proceeds are deposited. Therefore, in the stacked portion a, an Fe concentration gradient in the thickness direction thereof is formed.

Figure 5A:
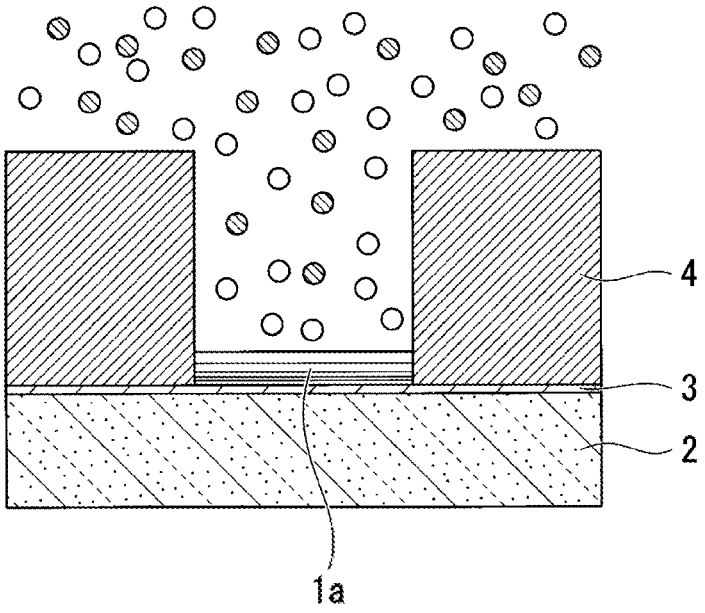
FIGS. 5A and 5B show views for illustrating details of a state of performing electroforming using the electroforming mold.

A state where the Fe ions 9 in the recessed portion 6 have decreased by continuing electroforming is shown in FIG. 5A. In the state shown in FIG. 5A, only one layer of the stacked portion 1*a* having an Fe concentration gradient is formed on the surface of the electrode 3 in the recessed portion 6.

After deposition is continued while remaining in the above-mentioned state for a predetermined time, for example, for about 100 to 120 seconds, an operation of stirring the electroforming solution or rotating or shaking the electroforming mold 7 in the electroforming solution at every jig is performed.

When the electroforming mold 7 is rotated, it is preferred to perform a rotation operation at a speed of about 10 rpm for about 5 to 30 seconds.

Figure 5B:
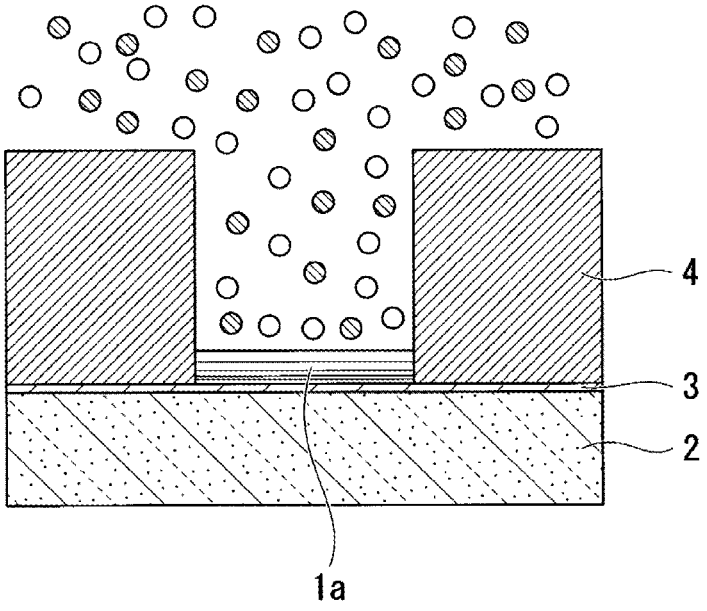

By any of these operations, the electroforming solution present in the recessed portion 6 is replaced with the electroforming solution having an average ion concentration present around the electroforming mold 7. This state is shown in FIG. 5B.

In the state shown in FIG. 5A, a crystal layer 1*b* having a high Fe concentration is deposited in an initial state on the electrode 3, and then, crystal layers 1*c*, 1*d*, and 1*e* having a gradually decreased Fe concentration are sequentially deposited. When the state is changed to a state shown in FIG. 5B by performing stirring of the electroforming solution or rotation of the electroforming mold 7, the crystal layer 1*b* having a high Fe concentration is deposited in the initial state again from there, and the crystal layers 1*c*, 1*d*, and 1*e* having a gradually decreased Fe concentration are sequentially deposited.

By doing in this manner, a roughly layered form portion 1A in which the stacked portion 1*a* having an inclined Fe content in the thickness direction is repeatedly stacked is formed.

As an Fe concentration difference in the stacked portion 1*a*, with respect to an intermediate Fe concentration which is an intermediate value between the crystal layer having the maximum Fe concentration and the crystal layer having the lowest Fe concentration, it is preferred that the Fe concentration is inclined within a concentration difference range of 15% or more and ±50% or less of the intermediate concentration.

Further, even if the concentration is within this range, the concentration is desirably within a concentration difference range of ±20% or more and ±45% or less of the intermediate concentration, and most desirably within a concentration difference range of ±22% or more and =41% or less of the intermediate concentration.

By repeatedly performing deposition for about 100 to 120 seconds and rotation of the electroforming mold 7 (or stirring of the electroforming solution or shaking of the electroforming mold 7), the metal stacked body 10 having the roughly layered form portion 1A with a predetermined thickness in which the stacked portion 1*a* having an inclined Fe content in the thickness direction is repeatedly stacked a plurality of times can be formed.

When electroforming is performed at the above-mentioned cathode current density using the above-mentioned electroforming solution, stacking can be performed in a repeating cycle in which the thickness of the stacked portion 1*a* is set to about 1 to 2 μm under the conditions in which the thickness of the photoresist is from 100 to 300 μm and the inner width of the opening portion is from 50 to 100 μm.

The metal stacked body 10 having a thickness equal to or more than the thickness of the recessed portion 6 is deposited. That is, the depth of the recessed portion 6 is equal to the thickness of the electroformed body 1, and therefore, the Ni—Fe alloy is allowed to grow until at least the recessed portion 6 of the electroforming mold 7 is buried with the metal stacked body 10. However, when a grinding and polishing step shown in FIG. 3E is omitted in the subsequent step, the metal stacked body 10 is deposited so that the thickness of the metal stacked body 10 is the same as the thickness of the electroformed body 1.

Figure 3E:
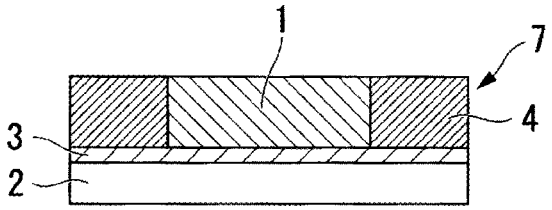

FIG. 3E is a view illustrating a grinding and polishing step. The metal stacked body 10 obtained in the above-mentioned electroforming step is ground so as to have the same thickness as the electroformed body 1, and the surface thereof is polished and finished to have a mirror-finished surface.

Specifically, after the electroforming mold 7 in which the metal stacked body 10 is formed is taken out from the electroforming tank, the metal stacked body 10 is ground together with the electroforming mold 7 so as to have the same thickness dimension as the electroformed body 1. In this embodiment, the grinding is performed so that the surface portion of the metal stacked body 10 formed above the surface of the electroforming mold 7 is removed (so that the electroformed body 1 formed in the recessed portion 6 is left).

Figure 3F:
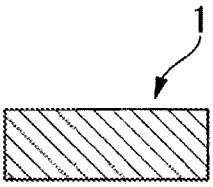

FIG. 3F is a view illustrating a step of taking out the electroformed body.

In the step of taking out the electroformed body, the electroformed body is taken out by removing the substrate 2, the electrode 3, and the photoresist 4, however, a removing method is not particularly limited, and these members can be removed by, for example, etching. Further, a method for taking out the electroformed body 1 by applying a physical force may be performed. By doing this, the electroformed body 1 composed of a desired Ni—Fe alloy can be obtained.

Further, the crystal structures may be equalized by subjecting this electroformed body 1 to a heating treatment at 250° C. for about 3 hours.

According to the electroformed body 1 produced by the above-mentioned method, the electroformed body 1, which is in a plate-like shape shown in FIG. 1A, and in which a plurality of stacked portions 1*a* are stacked in the thickness direction as shown in FIG. 1B, in other words, in the electroforming growing direction, and each stacked portion 1*a* has an Fe concentration gradient is obtained.

According to this electroformed body 1, the electroformed body is composed of a Ni—Fe alloy containing Fe at 5 to 25%, and therefore, the electroformed body having excellent mechanical properties such that the yield stress is about 1500 MPa or more and the Young's modulus is 150 GPa or more and an excellent spring property can be obtained.

Further, when the recessed portion 6 formed in the photoresist 4 is formed by UV curing and engraving through etching, processing can be performed with much higher precision as compared with general machining, and therefore, the obtained electroformed body 1 is formed with high dimensional precision.

It has been revealed in the specification of JP-A-2014-198897 by the applicant of the present application that according to the electroformed body 1 of a Ni—Fe alloy having the above-mentioned composition, the above-mentioned excellent mechanical properties are exhibited, and it has been proved that excellent Young's modulus, Vickers hardness, etc., as an assembly part such as a timepiece part can be obtained. For example, according to the electroformed body 1 of a Ni—Fe alloy having the above-mentioned composition, a Vickers hardness (Hv) of 580 or more, preferably about 620 to 630 can be obtained, and the electroformed body having a yield stress of about 1400 MPa or more and a Young's modulus of about 150 to 170 GPa can be obtained.

In addition to these excellent mechanical properties, the electroformed body 1 of this embodiment has further excellent hardness and yield stress and stably excellent Young's modulus, and therefore is particularly excellent as a spring material to which a load acts in the arrow a direction shown in FIG. 1A, in other words, in a direction parallel to the layers of the stacked portion 1*a*.

For example, the electroformed body 1 having a hardness at a 670 to 720 Hv level, a yield stress at a 1500 to 1700 MPa level, and a Young's modulus at a 170 MPa level, and having an excellent spring property can be obtained.

With respect to the Ni—Fe alloy constituting the electroformed body 1, when the Fe content exceeds 25%, the alloy becomes brittle, and therefore, in consideration of a variation in Fe content, the upper limit of the Fe content is substantially set to about 15 to 20%.

The excellent mechanical properties previously revealed by the applicant of the present application in the specification of JP-A-2014-198897 are mechanical properties obtained in the Ni—Fe alloy made to contain Fe at about 25% by mass.

In the electroformed body 1 of this embodiment, the inclusion of the roughly layered form portion 1A in which the stacked portion 1*a* having an inclined Fe content in the thickness direction is repeatedly stacked a plurality of times effectively acts on, and even if the Fe content is set to about 10 to 17%, the electroformed body 1 which is not inferior to an Ni—Fe alloy having an Fe content of about 25%, and also can stably exhibit excellent mechanical properties at a high level as described above can be obtained.

According to the electroformed body 1 of this embodiment, as compared with a conventional Ni electroformed part or the like, coarsening of crystal grains is suppressed, and the mechanical properties such as a Young's modulus and a yield stress are improved as described above, and therefore, a technique for producing a small part with high precision can also be applied to a spring part as an assembly part of a timepiece, and the precision of a device (for example, a timepiece or the like) using the part with high precision is also improved. It can be applied to a spring part such as a chronograph coupling lever as an assembly part for a timepiece.

Further, since an electroforming step utilizing the photoresist 4 described above is adopted in the method for producing the electroformed body 1, the degree of freedom in the shape of the part is increased, and therefore, a mechanism which could not be achieved with a conventional machined part can be realized, and it contributes to reduction in size of the mechanism, and also contributes to reduction in size of a product such as a timepiece using the small mechanism.

Incidentally, in the electroformed body 1 of this embodiment, an electroformed body capable of achieving the object is obtained even if not all the structure is the roughly layered form portion 1A in which the stacked portion 1*a* is deposited.

For example, even if crystal grains that cannot be shown as the stacked portion 1*a* are partially contained as shown in FIG. 2A, if the roughly layered form portion 1A in which the stacked portion 1*a* is deposited is contained in the structure, an electroformed body capable of achieving the object of the present invention can be formed.

As one example, it is desired to include the roughly layered form portion 1A in which the stacked portion 1*a* is deposited at 50% by volume or more of the structure.

EXAMPLES

Next, the present invention will be described in more detail by way of Examples, however, the present invention is not limited to conditions used in the following Examples.

An electroforming mold was formed according to the method shown in FIG. 3A to 3C. When forming the electroforming mold, a S1 substrate having a thickness of 525 μm was adopted as a substrate and Au was adopted as an electrode.

Subsequently, by using the obtained electroforming mold, an electroformed body in a 10 cm square plate-like shape composed of a Ni—Fe alloy was produced by an electroforming device including an electroforming bath.

[Electroforming Bath Composition, pH and Bath Temperature]

As the composition of the electroforming bath, the following composition was used:

nickel sulfamate tetrahydrate: 200 to 300 g/L,
nickel chloride hexahydrate: 2 to 10 g/L,
ferrous sulfamate pentahydrate: 5 to 50 g/L,
boric acid: 10 to 50 g/L,
surfactant: 0.1 to 10 g/L,
primary brightener: 1 to 15 g/L,
secondary brightener: 0.05 to 5 g/L, and
antioxidant: 0.1 to 10 g/L;
pH: 2 to 4;
bath temperature: 40 to 60° C.

[Electroforming Conditions]

Electroformed bodies of Examples 1 to 3 were produced by repeating an operation of allowing an electric current to flow at a cathode current density of 4 A/dm$^2$ (45 μm/hour) for 115 seconds and thereafter performing rotation (jig rotation speed: 10 rpm) for 5 seconds.

As an electroformed body of Conventional Example, a sample in a plate-like shape having a thickness of about 150 μm was produced by allowing an electric current to continuously flow at a cathode current density of 4 A/dm$^2$ (45 m/hour) for 3 hours and 30 minutes.

With respect to the samples of Examples 1 to 3 and the sample of Conventional Example, a transverse section was cut out from each sample in a plate-like shape, and a component analysis was performed in the plate thickness direction by an SEM (scanning electron microscope).

Figure 6:
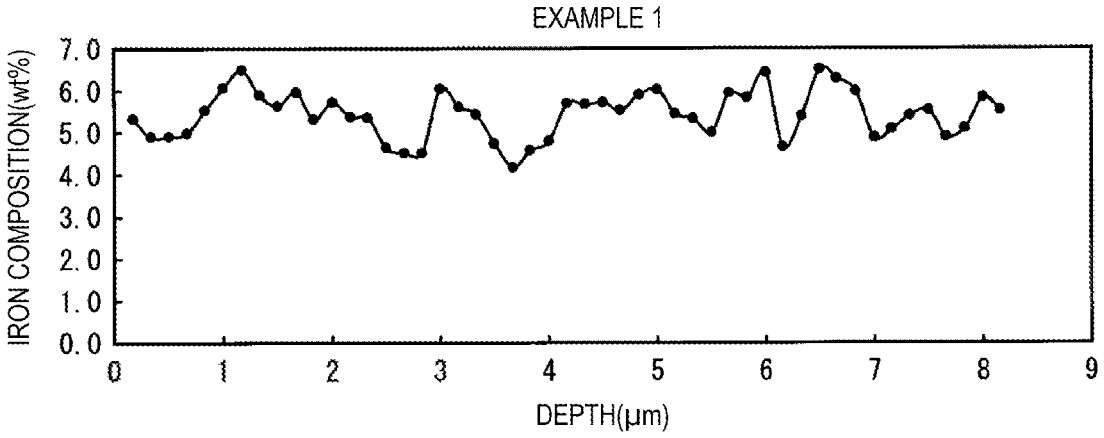
FIG. 6 is a graph showing one example of results of measuring an Fe composition in an electroformed body of Example 1 in a depth direction from a surface thereof by an SEM (scanning electron microscope).
Figure 7A:
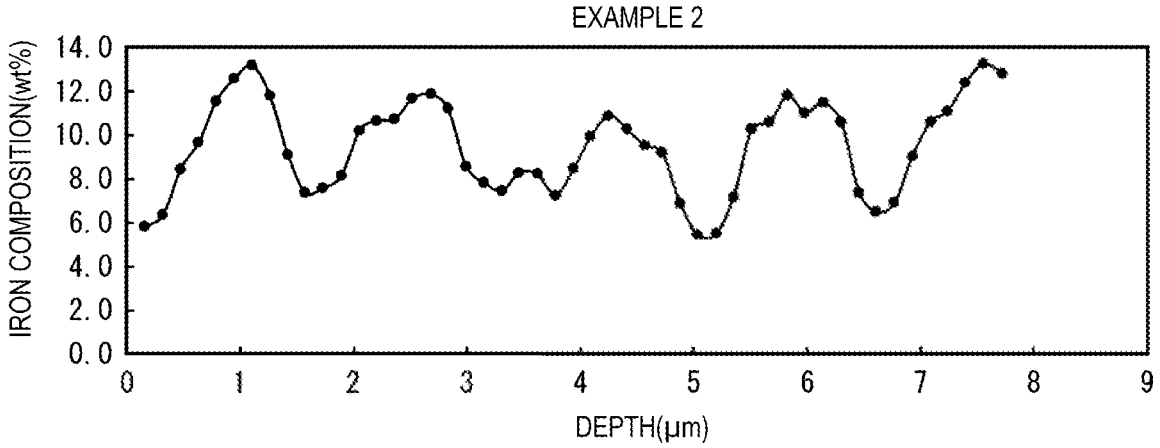
FIGS. 7A and 7B show measurement results for an electroformed body of Example 2.
Figure 7B:
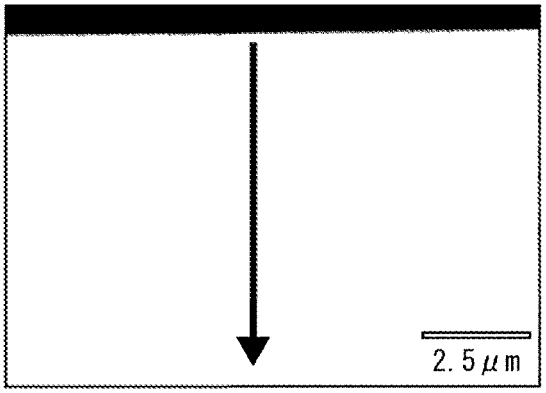
Figure 8A:
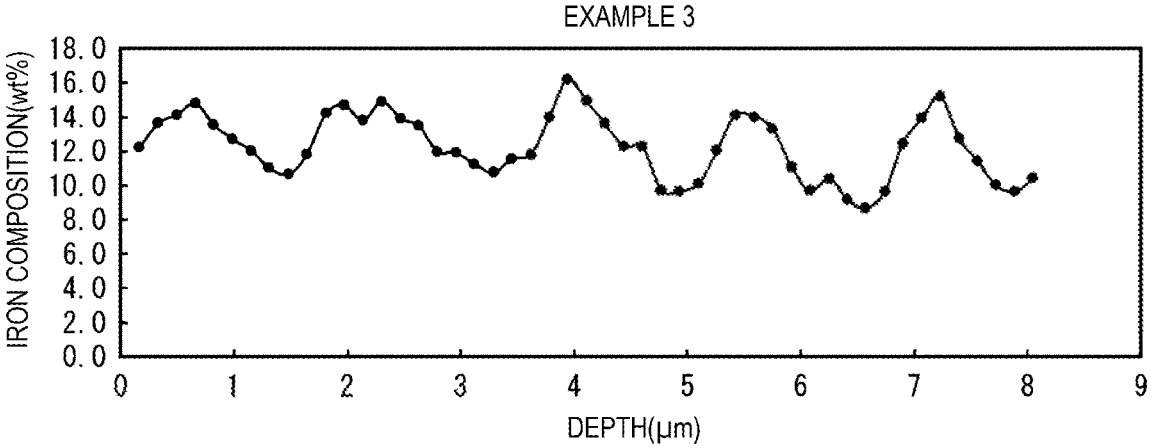
FIGS. 8A and 8B show measurement results for an electroformed body of Example 3.
Figure 8B:
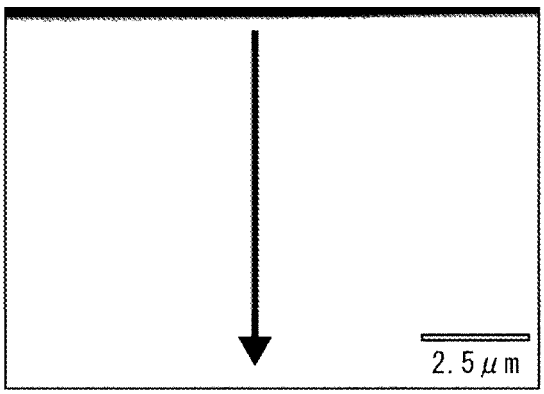
Figure 9A:
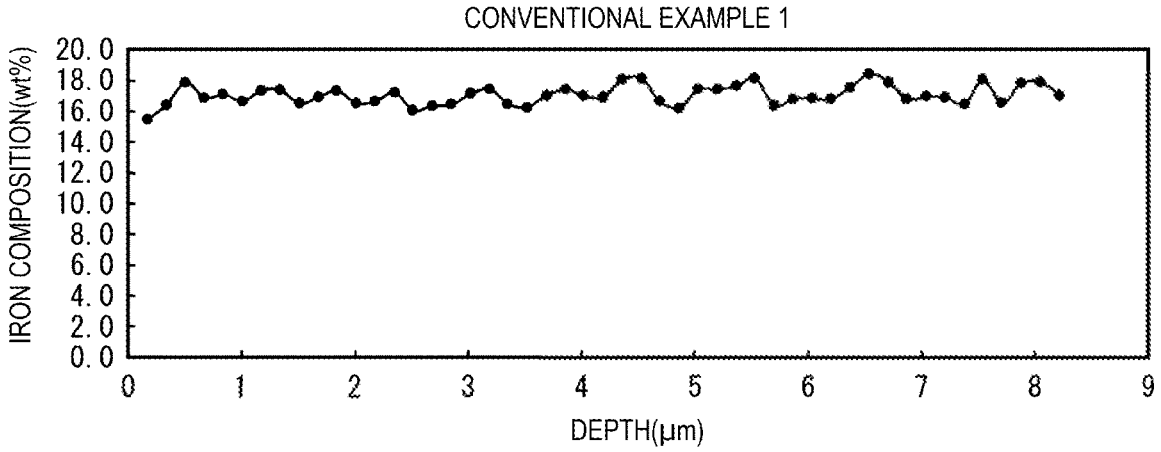
FIGS. 9A and 9B show measurement results for an electroformed body of Conventional Example.
Figure 9B:
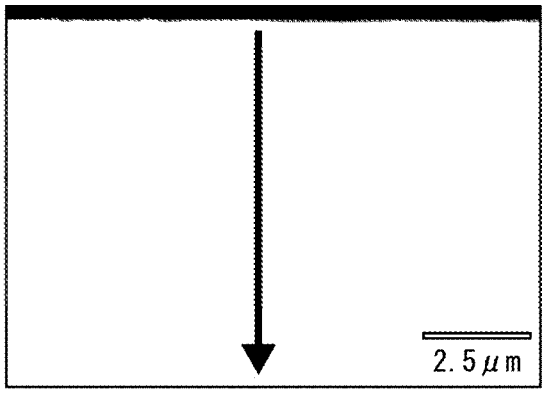

The analysis results of Example 1 are shown in FIG. 6, the analysis results of Example 2 are shown in FIGS. 7A and 7B, the analysis results of Example 3 are shown in FIGS. 8A and 8B, and the analysis results of Conventional Example 1 are shown in FIGS. 9A and 9B.

Incidentally, in FIG. 7B, a direction of analyzing the cross section of the sample of Example 2 is shown, in FIG. 8B, a direction of analyzing the cross section of the sample of Example 3 is shown, and in FIG. 9B, a direction of analyzing the cross section of the sample of Conventional Example is shown.

The sample of Example 1 is a sample that is a Ni—Fe alloy and has a composition aiming at an electroforming bath composition having an Fe concentration of 5.3% by mass, the sample of Example 2 is a sample that is a Ni—Fe alloy and has an electroforming bath composition aiming at an Fe concentration of 9.6% by mass, and the sample of Example 3 is a sample that is a Ni—Fe alloy and has an electroforming bath composition aiming at an Fe concentration of 14.9% by mass. The sample of Conventional Example 1 is a sample that is a Ni—Fe alloy and has an electroforming bath composition aiming at an Fe concentration of 17% by mass.

According to the analysis results of the Fe content in the thickness direction obtained from the samples of Examples 1 to 3, it is found that an increase and decrease of the Fe content is substantially periodically repeated with the progress of the measurement depth.

Therefore, it is found that the samples of Examples 1 to 3 all have a roughly layered form portion in which a stacked portion having an inclined Fe content in the thickness direction is repeatedly stacked a plurality of times.

Also in Conventional Example 1, an increase and decrease of the Fe concentration was seen, however, periodicity was unclear, and the difference between high and low concentrations was smaller than in Examples 1 to 3.

Therefore, with respect to Examples 1 to 3, in order to ascertain the variation of the Fe content, the numerical values of the maximum Fe concentration and the lowest Fe concentration were measured, and an intermediate concentration which is an intermediate value thereof was determined by calculation, and with respect to each of Examples 1 to 3, to what extent the variation range from the intermediate value the Fe concentration falls in was measured.

In the measurement results of Example 1, the maximum Fe concentration is 6.6% by mass when the depth is 6.6 μm, and the lowest Fe concentration is 4.2% by mass when the depth is 3.6 μm.

From these results, the intermediate concentration of Example 1 is 5.4% by mass and the Fe concentration falls in the range of 5.4% by mass ±1.2% by mass.

In the measurement results of Example 2, the maximum Fe concentration is 13.4% by mass when the depth is 7.6 μm, and the lowest Fe concentration is 5.6% by mass when the depth is 5.0 μm.

From these results, the intermediate concentration of Example 2 is 9.5% by mass and the Fe concentration falls in the range of 9.5% by mass ±3.9% by mass.

In the measurement results of Example 3, the maximum Fe concentration is 16.2% by mass when the depth is 4.0 μm, and the lowest Fe concentration is 8.4% by mass when the depth is 6.5 μm.

From these results, the intermediate concentration of Example 3 is 12.3% by mass and the Fe concentration falls in the range of 12.3% by mass ±3.9% by mass.

Subsequently, a ratio of the variation amount of each Example to the value of the intermediate concentration of each Example was determined by calculation.

The variation of 1.2% by mass of Example 1 corresponds to 22% of the intermediate concentration.

The variation of 3.9% by mass of Example 2 corresponds to 41% of the intermediate concentration.

The variation of 3.9% by mass of Example 3 corresponds to 31% of the intermediate concentration.

On the other hand, in the measurement results of Conventional Example 1, the maximum Fe concentration is 18.5% by mass when the depth is 6.5 μm, and the lowest Fe concentration is 15.5% by mass when the depth is 0.2 μm.

From these results, the intermediate concentration of Conventional Example 1 is 17.0% by mass and the Fe concentration falls in the range of 17.0% by mass ±1.5% by mass.

The variation of 1.5% by mass of Conventional Example 1 corresponds to 9% of the intermediate concentration.

When comparing the calculation results of Examples 1 to 3 with the calculation results of Conventional Example 1, it was found that with respect to the intermediate concentration which is an intermediate value between the maximum Fe concentration and the lowest Fe concentration in a structure having a roughly layered form portion in which a stacked portion having an inclined Fe content in the thickness direction is repeatedly stacked a plurality of times according to the present invention, the Fe composition is preferably inclined within a concentration difference range of ±15% or more and ±50% or less of the intermediate concentration.

Even if it is within this range, it is desirably within a concentration difference range of ±0.20% or more and ±45% or less of the intermediate concentration, and most desirably within a concentration difference range of ±22% or more and ±41% or less of the intermediate concentration.

With respect to the samples of Examples 1 to 3 and the sample of Conventional Example, the results of measuring the hardness (Hv), the Young's modulus (GPa), and the yield stress are shown in the following Table 1.

TABLE 1

| Properties | | Example 1 | Example 2 | Example 3 | Conventional Example 1 |
|---|---|---|---|---|---|
| Fe composition | (mass %) | 5.3 | 9.6 | 14.9 | 16.7 |
| Hardness (Hv) | ($kg/mm^2$) | 720 | 685 | 674 | 634 |
| Young's modulus | (GPa) | 172 | 174 | 170 | 176 |
| Yield stress | (MPa) | 1412 | 1729 | 1756 | 1437 |

As shown in Table 1, the electroformed bodies of Examples 1, 2, and 3 exhibited excellent mechanical properties equal to or better than the electroformed body of Conventional Example. In particular, when the Fe content in the Ni—Fe alloy is increased, excellent values are obtained for the Young's modulus and the yield stress, however, it is found that while Fe is contained at 16.7% by mass in Conventional Example, in Example 1, even if the Fe content is 5.3% by mass, equivalent Young's modulus and yield stress are exhibited. In Examples 2 and 3, although the Fe content is lower than in Conventional Example, a higher yield stress is exhibited, and an excellent value of a 1700 MPa class could be obtained.

From these results, it was found that according to an electroformed body having a roughly layered form portion in which a stacked portion having an inclined Fe content in the thickness direction is repeatedly stacked a plurality of times as in Examples of this application, even if the Fe content is lower than a conventional one, excellent mechanical properties are obtained.

Subsequently, a plurality of samples were produced using electroforming baths aiming at similar compositions to those for Examples 1, 2, and 3 and Conventional Example under the same production conditions as those for Examples 1, 2, and 3 and under the same production conditions as those for Conventional Example, and the results of measuring the hardness (Hv), the Young's modulus (GPa), and the yield stress are shown in the following Table 2 to Table 4.

TABLE 2

| Properties | | Example 4 | Example 5 | Example 6 | Example 7 | Example 8 |
|---|---|---|---|---|---|---|
| Fe composition | (mass %) | 6.3 | 9.4 | 9.7 | 9.7 | 9.0 |
| Hardness (Hv) | ($kg/mm^2$) | 728 | 692 | 704 | 692 | 695 |
| Young's modulus | (GPa) | 180 | 176 | 170 | 180 | 175 |
| Yield stress | (MPa) | 1550 | 1742 | 1621 | 1700 | 1694 |

TABLE 3

| Properties | | Example 9 | Example 10 | Example 11 | Example 12 | Example 13 |
|---|---|---|---|---|---|---|
| Fe composition | (mass %) | 14.1 | 14.1 | 14.3 | 13.8 | 17.9 |
| Hardness (Hv) | ($kg/mm^2$) | 670 | 675 | 674 | 674 | 666 |
| Young's modulus | (GPa) | 172 | 170 | 169 | 169 | 171 |
| Yield stress | (MPa) | 1774 | 1704 | 1683 | 1683 | 1677 |

TABLE 4

| Properties | | Example 14 | Conventional Example 2 | Conventional Example 3 | Conventional Example 4 | Conventional Example 5 |
|---|---|---|---|---|---|---|
| Fe composition | (mass %) | 17.3 | 16.0 | 17.0 | 16.2 | 17.4 |
| Hardness (Hv) | ($kg/mm^2$) | 663 | 637 | 638 | 638 | 648 |
| Young's modulus | (GPa) | 167 | 176 | 175 | 175 | 176 |
| Yield stress | (Mpa) | 1654 | 1501 | 1572 | 1572 | 1567 |

Examples 4 to 14 showed the same tendency as Examples 1 to 3, and Conventional Examples 2 to 5 showed the same tendency as Conventional Example 1.

From these results, in Examples 4 to 12, although the Fe content is lower than in Conventional Examples, a higher yield stress is exhibited, and an excellent value of a 1700 MPa class could be obtained.

From these results, it was found that according to an electroformed body having a roughly layered form portion in which a stacked portion having an inclined Fe content in the thickness direction is repeatedly stacked a plurality of times as in Examples of this application, even if the Fe content is lower than a conventional one, excellent mechanical properties are obtained.

Further, with respect to the samples of Examples 1 to 14, the average crystal grain diameters of the crystal grains constituting the stacked portion were measured by X-ray diffractometry and found to fall within the range of 20 to 30 nm in all the samples.

What is claimed is:

1. An electroformed part composed of a nickel-iron alloy that contains Fe at 5 to 25% by mass, Ni at a remaining percentage by mass and a fraction of unavoidable impurities, wherein the electroformed part is generally configured in layers layered in a thickness direction of the electroformed part, and a Fe content in the electroformed part generally repeats a decrease and an increase alternatively in the thickness direction and a Ni content in the electroformed part also changes complementarily, wherein the Fe content generally decreases within each layer in the thickness direction and generally increases around a bound of two adjacent layers.

2. The electroformed part according to claim 1, wherein each layer comprises crystal grains having an average grain diameter of 50 nm or less as measured by X-ray diffractometry.

3. The electroformed part according to claim 2, wherein each crystal grain is shaped in a crystal form having a face-centered cubic lattice single layer, and a nickel atom is partially substituted by an iron atom.

4. The electroformed part according to claim 2, wherein the crystal grains have different Fe contents, each layer has crystal grains whose Fe content changes from high to low in the thickness direction.

5. The electroformed part according to claim 2, wherein each crystal grain has a Fe content that changes from high to low within the crystal grain, and the sizes of the crystal grains in each layer change from smaller to larger in the thickness direction.

6. The electroformed part according to claim 1, wherein the Fe content in each layer changes within a concentration difference range of ±15% or more and ±50% or less of an intermediate concentration, where the intermediate concentration is an intermediate value between a maximum Fe concentration and a lowest Fe concentration.

7. The electroformed part according to claim 1, wherein each layer has a thickness of 500 nm or more and 10 μm or less.

8. The electroformed part according to claim 1, wherein the electroformed part is set to receive a mechanical load in the thickness direction.

9. A timepiece, wherein an assembly part composed of the electroformed part according to claim 1 is provided.

10. The timepiece according to claim 9, wherein the assembly part is a spring part.

* * * * *